US008915314B2

(12) United States Patent
Lyon

(10) Patent No.: US 8,915,314 B2
(45) **Date of Patent: *Dec. 23, 2014**

(54) DOWN-THE-HOLE DRILL DRIVE COUPLING

(75) Inventor: Leland H. Lyon, Roanoke, VA (US)

(73) Assignee: Center Rock Inc., Berlin, PA (US)

( * ) Notice: Subject to any disclaimer, the term of this patent is extended or adjusted under 35 U.S.C. 154(b) by 773 days.

This patent is subject to a terminal disclaimer.

(21) Appl. No.: 12/933,041

(22) PCT Filed: Mar. 31, 2009

(86) PCT No.: PCT/US2009/038957

§ 371 (c)(1),
(2), (4) Date: Oct. 14, 2010

(87) PCT Pub. No.: WO2009/124051

PCT Pub. Date: Oct. 8, 2009

(65) Prior Publication Data

US 2011/0036636 A1 Feb. 17, 2011

Related U.S. Application Data

(60) Provisional application No. 61/040,817, filed on Mar. 31, 2008.

(51) Int. Cl.
*E21B 4/00* (2006.01)
*E21B 4/14* (2006.01)

(52) U.S. Cl.
CPC ..... *E21B 4/14* (2013.01)
USPC ..... 175/293; 175/135; 175/296

(58) Field of Classification Search
CPC ..... E21B 4/14
USPC ..... 175/135–136, 293, 296; 173/90, 91, 94
See application file for complete search history.

(56) References Cited

U.S. PATENT DOCUMENTS 1,330,736 A * 2/1920 Church ..... 175/92
1,815,660 A 7/1931 Walker
2,038,602 A 4/1936 Redinger (Continued)

FOREIGN PATENT DOCUMENTS

EP 1910640 B1 4/2008
KR 10-2006-0106388 10/2006

(Continued)

OTHER PUBLICATIONS

Office Action issued Dec. 23, 2011 in U.S. Appl. No. 12/621,155.

(Continued)

*Primary Examiner* — James G Sayre
(74) *Attorney, Agent, or Firm* — Kim Winston LLP

(57) ABSTRACT

A down-the-hole drill hammer is provided that includes a housing, a piston mounted within the housing, a drill bit mounted below the housing, and a drive coupling operatively engaged with the housing and drill bit. The drive coupling can be configured with a plurality of lugs circumferentially disposed about the drill bit and coupled with the casing for providing rotation thereof. Alternatively, the drive coupling can be configured with segmented lugs configured to circumscribe the drill bit, or as a cylindrical chuck formed out of arch-shaped chuck segments which radially assemble onto the shank of the drill bit.

6 Claims, 9 Drawing Sheets

(56) References Cited

U.S. PATENT DOCUMENTS

| | | | | |
|---|---|---|---|---|
| 2,379,472 | A | 7/1945 | Bowman | |
| 2,710,740 | A | 6/1955 | Dempsey | |
| 3,893,521 | A | 7/1975 | Bailey et al. | |
| 3,991,834 | A | 11/1976 | Curington | |
| 4,050,525 | A | 9/1977 | Kita | |
| 4,085,809 | A | 4/1978 | Lovell et al. | |
| 4,333,537 | A | 6/1982 | Harris et al. | |
| 4,530,408 | A | 7/1985 | Toutant | |
| 4,691,779 | A | 9/1987 | McMahan et al. | |
| 4,765,418 | A * | 8/1988 | Ennis | 175/396 |
| 4,819,739 | A | 4/1989 | Fuller | |
| 4,878,550 | A | 11/1989 | Chuang | |
| 4,919,221 | A | 4/1990 | Pascale | |
| 5,065,827 | A | 11/1991 | Meyers et al. | |
| 5,085,284 | A | 2/1992 | Fu | |
| 5,301,761 | A | 4/1994 | Fu et al. | |
| 5,305,837 | A | 4/1994 | Johns et al. | |
| 5,322,136 | A | 6/1994 | Bui et al. | |
| 5,322,139 | A | 6/1994 | Rose et al. | |
| 5,398,772 | A | 3/1995 | Edlund | |
| 5,794,516 | A | 8/1998 | Wolfer et al. | |
| 5,915,483 | A | 6/1999 | Gien | |
| 5,984,021 | A | 11/1999 | Pascale | |
| RE36,848 | E | 9/2000 | Bui et al. | |
| 6,125,952 | A | 10/2000 | Beccu et al. | |
| 6,131,672 | A | 10/2000 | Beccu et al. | |
| 6,135,216 | A | 10/2000 | Lyon et al. | |
| 6,170,581 | B1 | 1/2001 | Lay | |
| 6,237,704 | B1 | 5/2001 | Lay | |
| 6,263,969 | B1 | 7/2001 | Stoesz et al. | |
| D454,143 | S | 3/2002 | Åsberg | |
| 6,502,650 | B1 | 1/2003 | Beccu | |
| 6,637,520 | B1 | 10/2003 | Purcell | |
| 6,698,537 | B2 | 3/2004 | Pascale et al. | |
| 6,708,784 | B1 | 3/2004 | Borg | |
| 7,017,682 | B2 | 3/2006 | Chan et al. | |
| 7,117,939 | B1 * | 10/2006 | Hawley et al. | 166/99 |
| 7,159,676 | B2 | 1/2007 | Lyon | |
| 7,163,058 | B2 | 1/2007 | Bakke et al. | |
| 7,198,120 | B2 | 4/2007 | Gien | |
| 7,389,833 | B2 | 6/2008 | Walker et al. | |
| 7,467,675 | B2 | 12/2008 | Lay | |
| 7,617,889 | B2 | 11/2009 | Beccu | |
| 8,312,944 | B2 | 11/2012 | Marshall et al. | |
| 2003/0102167 | A1 * | 6/2003 | Pascale et al. | 175/415 |
| 2004/0188146 | A1 | 9/2004 | Egerstrom | |
| 2006/0225885 | A1 | 10/2006 | Mcgarian et al. | |
| 2006/0249309 | A1 | 11/2006 | Cruz | |
| 2007/0039761 | A1 | 2/2007 | Cruz | |
| 2007/0102196 | A1 * | 5/2007 | Bassinger | 175/296 |
| 2008/0087473 | A1 | 4/2008 | Hall et al. | |
| 2008/0156539 | A1 | 7/2008 | Ziegenfuss | |
| 2009/0294180 | A1 * | 12/2009 | Swadi et al. | 175/293 |
| 2010/0059284 | A1 * | 3/2010 | Lyon et al. | 175/296 |
| 2010/0089649 | A1 | 4/2010 | Welch et al. | |
| 2010/0243333 | A1 | 9/2010 | Purcell | |
| 2010/0252330 | A1 | 10/2010 | Gilbert et al. | |
| 2011/0303464 | A1 | 12/2011 | Mulligan | |
| 2012/0118648 | A1 * | 5/2012 | Lorger | 175/296 |

FOREIGN PATENT DOCUMENTS

| | | | |
|---|---|---|---|
| WO | 2007010513 | A1 | 1/2007 |
| WO | 2007077547 | A1 | 7/2007 |
| WO | 2009124051 | A2 | 10/2009 |
| WO | 2010082889 | | 7/2010 |

OTHER PUBLICATIONS

Office Action issued Jan. 19, 2012 in U.S. Appl. No. 12/361,263.

Office Action issued Feb. 1, 2012 in AU Application No. 2009231791.

Office Action issued Sep. 15, 2011 in AU Application No. 2009231791.

Written Opinion Issued Feb. 22, 2011 in Int'l Application No. PCT/US2010/021011, 4 pages.

Office Action Issued Apr. 11, 2011 in U.S. Appl. No. 12/621,155.

Office Action issued Jun. 30, 2011 in SE Application No. 1051069-1.

Office Action issued Oct. 18, 2011 in U.S. Appl. No. 12/621,155.

Office Action issued Nov. 29, 2012 in U.S. Appl. No. 12/621,155.

Office Action issued Nov. 8, 2012 in Canadian Application No. 2,750,810.

Examination Report issued Dec. 7, 2012 in Australian Application No. 2010208528.

Office Action issued Feb. 7, 2012 in Chilean Patent Application No. 1015/2010.

International Preliminary Report on Patentability issued Mar. 13, 2012 in International Application No. PCT/US2010/021011.

Office Action issued May 17, 2011 in U.S. Appl. No. 12/361,263.

Int'l Search Report issued May 31, 2011 in Int'l Application No. PCT/US2010/056917; Written Opinion.

International Preliminary Report on Patentability issued on Oct. 5, 2010 in International Application No. PCT/US2009/038957.

Office Action Issued Dec. 7, 2010 in U.S. Appl. No. 12/361,263.

Office Action issued May 10, 2012 in U.S. Appl. No. 12/361,263.

Office Action issued Jun. 7, 2012 in U.S. Appl. No. 12/621,155.

Office Action issued Jun. 4, 2012 in Canadian App. No. 2,718,669.

Office Action issued May 14, 2012 in Swedish App. No. 1150769-6.

Office Action issued Jun. 21, 2012 in Swedish App. No. 1150985-8.

Int'l Search Report and Written Opinion issued on May 26, 2009 in Int'l Application No. PCT/US2009/038957.

Int'l Search Report and Written Opinion Issued Mar. 19, 2010 in Int'l Application No. PCT/US2010/021011.

Office Action Issued Jun. 24, 2010 in U.S. Appl. No. 12/361,263.

Office Action issued May 31, 2013 in Australian Application No. 2011235927.

Office Action issued May 7, 2013 in Chilean Application No. 1785-2011.

Office Action issued Mar. 13, 2013 in U.S. Appl. No. 12/909,495.

Office Action issued Mar. 22, 2013 in Swedish Application No. 1250524-4.

Office Action issued Apr. 17, 2013 in Swedish Application No. 1051069-1.

Office Action issued Apr. 15, 2013 in Korean Application No. 10-2011-7019644.

Office Action issued May 28, 2013 in U.S. Appl. No. 12/621,155.

Office Action issued May 9, 2013 in Canadian Application No. 2,755,592.

Office Action issued May 10, 2013 in Canadian Application No. 2,750,810.

Office Action issued Aug. 26, 2013 in U.S. Appl. No. 12/909,495.

Office Action issued Oct. 24, 2013 in Korean Patent Application No. 2012-7015756.

Office Action issued Apr. 28, 2014 in Korean Patent Application No. 2012-7015756.

* cited by examiner

DOWN-THE-HOLE DRILL DRIVE COUPLING

CROSS-REFERENCE TO RELATED APPLICATIONS

This application is a Section 371 of International Application No. PCT/US2009/308957, filed Mar. 31, 2009, which was published in the English language on Oct. 8, 2008 under International Publication No. WO 2009/124051 A3, which claims the benefit of priority pursuant to 35 U.S.C. §119(e) of U.S. Provisional Patent Application No. 61/040,817, filed Mar. 31, 2008, the disclosures of which are incorporated herein by reference.

BACKGROUND OF THE INVENTION

The present invention generally relates to a down-the-hole drill ("DHD"). In particular, the present invention relates to a drive coupling for a DHD hammer.

Typical DHDs include a hammer having a piston that is moved cyclically with high pressure gas (e.g., air). The piston generally has two end surfaces that are exposed to working air volumes (i.e., a return volume and a drive volume) that are filled and exhausted with each cycle of the piston. The return volume pushes the piston away from its impact point on a bit end of the hammer. The drive volume accelerates the piston toward its impact location on the back end of the drill bit. The overall result is a percussive drilling action.

Conventional drill bits, as shown in FIG. 1, used in DHD applications are typically constructed of a single integral piece of alloy metal made from a forging process, which requires costly raw materials and expensive manufacturing processes. The drill bit 1000, includes two sections, a head section 1120 and a shank section 1140. The head section 1120 forms the cutting end of the DHD drill. The shank section 1140, which is an elongated shank and extends into the main housing of the DHD, attaches to the DHD hammer (not shown), and includes a plurality of axially extending, circumferentially spaced splines 1160.

In operation of such conventional drill bits, the piston of the DHD hammer (which is driven by working air volumes) percussively impacts the back end 1180 of the shank section 1140 while a chuck (not shown) intermittently engages the splines 1160 on the shank section 1140 to rotationally move the drill bit 1000 about a central axis. The working air volumes are typically exhausted from the DHD hammer through an exhaust tube 1200 at the back end of the shank section 1140. Such impacts upon the back end 1180 of the shank section 1140 take place within the body of the main housing of the DHD hammer. Such impacts also makes the drill bit 1000 susceptible to elastic stress waves, which can lead to ultimate fatigue failure, due in part to the elongated nature of the shank 1140 and the aggressive sectional change between the head 1120 and shank 1140 sections.

The chuck, which is threadedly connected to the DHD hammer casing (not shown), operates to engage the splines 1160 on the shank section 1140 to provide for rotational movement. This movement of the chuck however, results in increased stresses created by the relatively small torque transmission diameter of the shank section 1140 compared to the head section 1120 and because of the high intensity elastic strain wave that passes through this small diameter section. As a result, localized burning and/or galling of the splines 1160 in the area between the head section 1120 and the chuck often results, which can lead to accelerated fatigue failure and then part failure. Moreover, due to the high torque forces applied by the chuck over a relatively small surface area on the splines 1160, the chuck threads can seize upon the DHD hammer. The seized chuck threads can make removal of the chuck and/or drill bit 1000 extremely difficult and costly.

Accordingly, there is a need for a low cost drill bit for DHDs that is not limited by the problems associated with conventional DHD hammers.

BRIEF SUMMARY OF THE INVENTION

Briefly stated, the present invention comprises a down-the-hole drill hammer that includes a cylindrical housing and a piston mounted within the housing along a longitudinal direction. The piston is configured to reciprocatively move within the housing along the longitudinal direction. The down-the-hole drill hammer further includes a drill bit disposed distal to the housing. The drill bit includes a head, a shank extending from the head and a drive coupling operatively engaging the housing and the drill bit.

BRIEF DESCRIPTION OF THE SEVERAL VIEWS OF THE DRAWINGS

The following detailed description of the preferred embodiments of the present invention will be better understood when read in conjunction with the appended drawings. For the purposes of illustrating the invention, there are shown in the drawings embodiments which are presently preferred. It is understood, however, that the invention is not limited to the precise arrangements and instrumentalities shown. In the drawings.

DETAILED DESCRIPTION OF THE INVENTION

Reference will now be made in detail to the present examples of the invention illustrated in the accompanying drawings. Wherever possible, the same or like reference numbers will be used throughout the drawings to refer to the same or like portions. It should be noted that the drawings are in simplified form and are not drawn to precise scale. In reference to the disclosure herein, for purposes of convenience and clarity only, directional terms such as top, bottom, above, below and diagonal, are used with respect to the accompanying drawings. Such directional terms used in conjunction with the following description of the drawings should not be construed to limit the scope of the invention in any manner not explicitly set forth.

Figure 1:
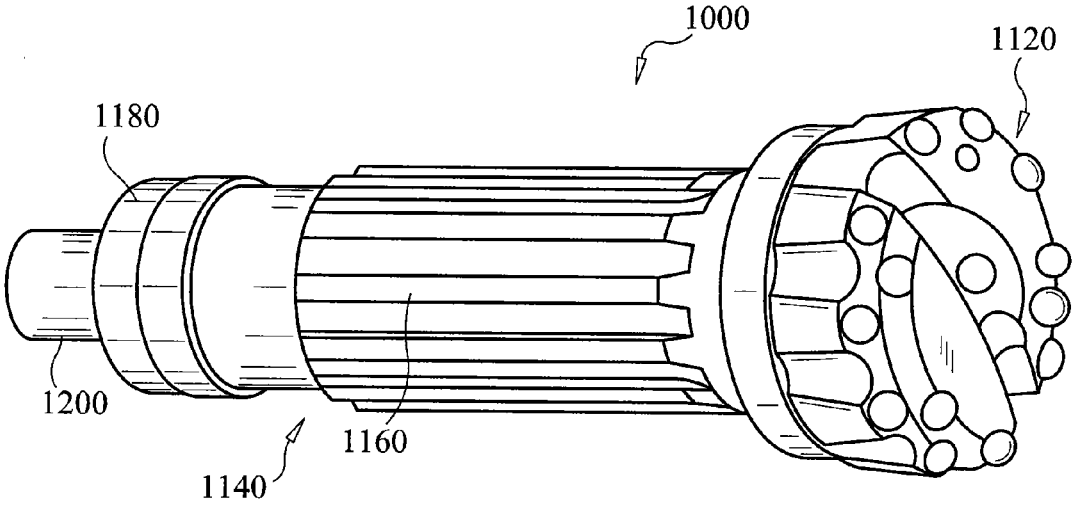
FIG. 1 PRIOR ART
FIG. 1 is a perspective view of a conventional DHD hammer's drill bit.
Figure 3:
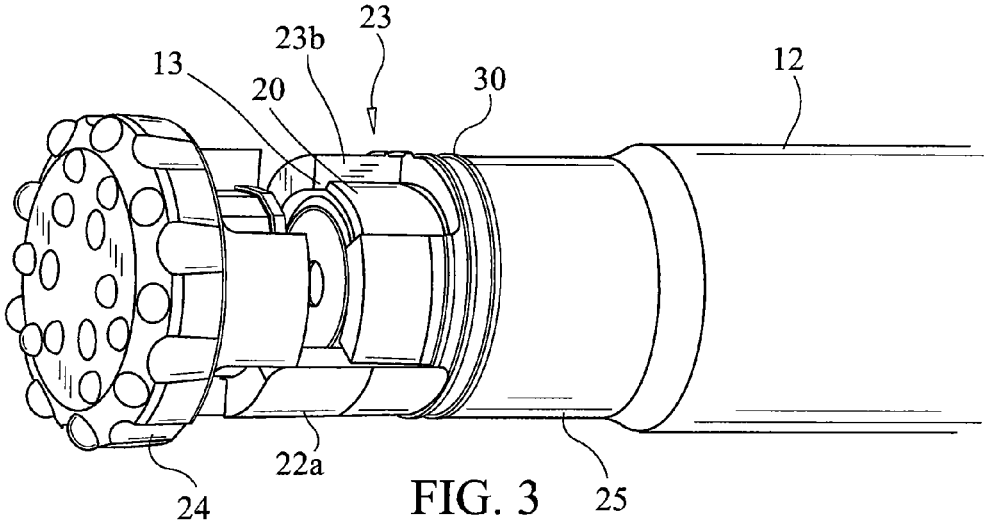
FIG. 3 is an enlarged partial perspective view of the embodiment of FIG. 2 with a lug removed.
Figure 4:
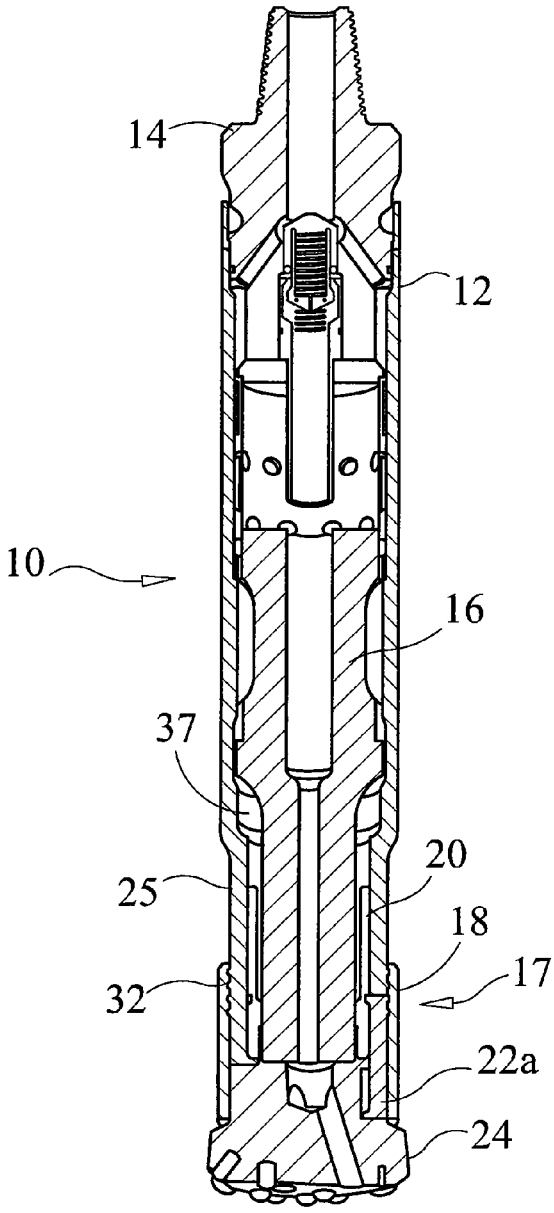
FIG. 4 is a cross-sectional perspective view of the embodiment of FIG. 2 with the drill bit in the impact position and with a sleeve.

In a preferred embodiment, the present invention provides for a DHD hammer 10, as shown in FIGS. 2-9. The DHD hammer 10 includes a housing or casing 12, a backhead 14, a piston 16, a drive coupling 17, and a drill bit 24. The casing 12 has a generally hollow cylindrical configuration to allow for the casing 12 to at least partially or completely house the backhead 14, piston 16 and drive coupling 17. Toward the bottom or distal end, the casing 12 includes a taper 28 that leads into a reduced diameter section 25. Further down the casing 12, the casing 12 is configured with a connector, such as threads 30 for engagement with corresponding threads 32 on a surrounding sleeve 18 (FIG. 4). At the most distal end, the casing 12 is configured with a plurality of lug recesses 23 for receiving corresponding lugs 22*a-c* of the drive coupling 17. In the present embodiment, the plurality of lug recesses 23 includes three lug recesses 23*a-c* (only 23*b* shown in FIG. 3).

The backhead 14 can be any conventional backhead 14 readily used in DHD hammers. The structure and operation of such backheads are readily known in the art and a detailed description of the backhead 14 is not necessary for a complete understanding of the present invention. However, an exemplary backhead 14 suitable for use in the present embodiment is described in U.S. patent application Ser. No. 12/361,263 assigned to Center Rock, Inc. U.S. patent application Ser. No. 12/361,263 is hereby incorporated by reference in its entirety. Torque, thrust, compressed air power and rotation are supplied to the DHD hammer 10 through the backhead pipe connection 15 which connects to the down-the-hole drill. The torque and rotation is further conveyed to the drill bit 24 by the casing 12 itself, which rotates along with the backhead pipe connection 15.

The piston 16 can be any conventional piston readily used in DHD hammers. The structure and operation of such pistons is readily known in the art and a detailed description of the piston 16 is not necessary for a complete understanding of the present invention. However, a piston 16 suitable for use in the present embodiment is described in U.S. patent application Ser. No. 12/361,263. In general, the piston 16 is mounted within the casing 12 along a longitudinal direction and configured to reciprocatively move within the casing 12 along the longitudinal direction.

The drive coupling 17 includes a bearing 20, a plurality of lugs 22 (FIG. 7) and a surrounding sleeve 18 and is generally configured to operatively engage the casing 12 and drill bit 14. Referring to FIG. 4, the sleeve 18 is a cylindrical sleeve configured with a connector 32, such as internal threads 32 about the proximate end of the sleeve 18 for engagement with the external threads 30 on the distal end of the casing 12. The distal end of the sleeve 18 is generally configured to receive the plurality of lugs 22 when the plurality of lugs 22 are assembled to the DHD hammer 10. In addition, the distal end of the sleeve 18 is configured to receive the plurality of lugs 22 and the shank 44 (see FIG. 9) of the drill bit 24 when positioned in the impact ready position, as shown in FIG. 4. The sleeve 18 can optionally be configured with a taper along an inner surface to provide for a tapered fit.

Figure 5:
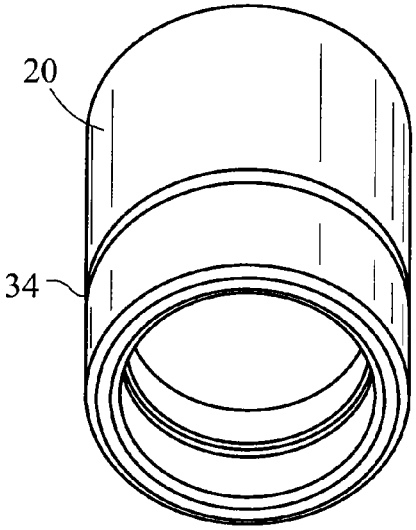
FIG. 5 is an enlarged perspective view of the bearing of the embodiment of FIG. 4.
Figure 6:
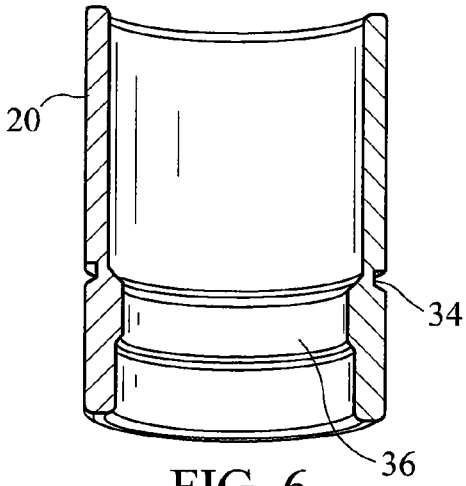
FIG. 6 is an enlarged cross-sectional perspective view of the bearing of FIG. 5.

The bearing 20, as best shown in FIGS. 5 and 6, has a generally hollow cylindrical configuration. The bearing 20 is sized and shaped to fit within the casing 12 and to allow an unobstructed passageway for the piston 16 to travel through so as to be able to receive a distal portion of the piston 16. The bearing 20 is retained proximate to the distal end of the casing 12 by a radially inwardly extending ridge 13 extending from the casing 12. Along the bottom half of the bearing 20 along its outer surface is an annular inset slot 34 configured to engage with a top or proximate flange 38 (see FIG. 8) on each of the plurality of lugs 22 to prevent axial movement of the lugs 22. Along the bottom inner surface, the bearing 20 is configured with an annular ridge 36 that protrudes radially inwardly relative to the bearing 20 wall. The annular ridge 36 cooperates with the piston 16 to create a valve for exhausting air from the DHD hammer's 10 return chamber 37 (as shown on FIG. 4).

Figure 2:
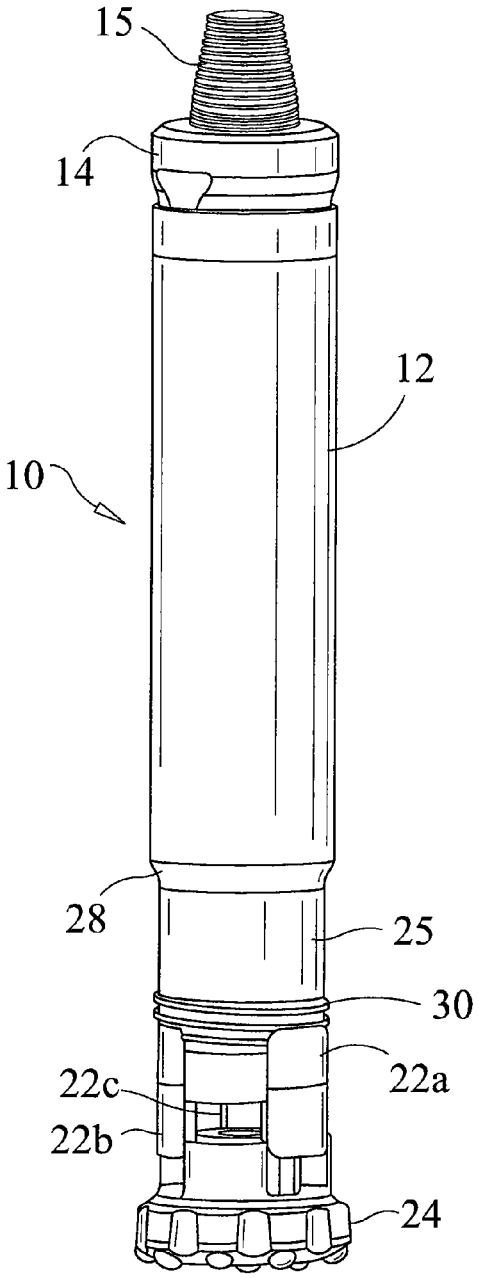
FIG. 2 is a perspective view of a DHD hammer with a drill bit in the drop down position and without a sleeve in accordance with a preferred embodiment of the present invention.
Figure 7:
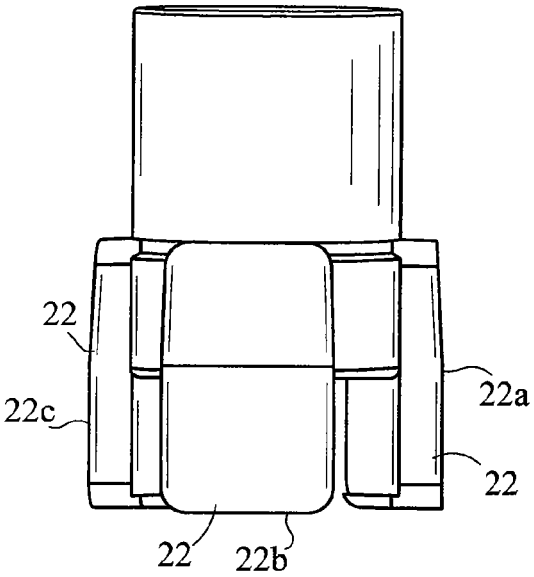
FIG. 7 is an enlarged side elevational view of the bearing and lugs of the embodiment of FIG. 4 in an assembled state.
Figure 8:
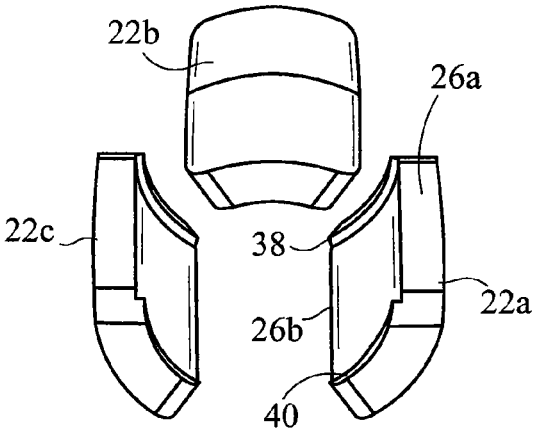
FIG. 8 is an enlarged perspective view of the lugs of the embodiment of FIG. 4.

The plurality of lugs 22, as assembled to the DHD hammer 10, are shown in FIG. 2. The plurality of lugs 22 includes three lugs 22*a-c*, as best shown in FIGS. 7 and 8. Alternatively, the DHD hammer 10 can be configured with more than three or less than three lugs. The lugs 22*a-c* are generally configured as shown in FIGS. 7 and 8 and each includes lug drive surfaces 26*a*, 26*b*. About the proximal and distal ends of each of the lugs 22*a-c* there is an annular flange 38, 40 that is directed radially inwardly. The proximal flange 38 of each lug 22*a-c* is configured to connectably engage with the annular inset slot 34 of the bearing 20, as shown in FIGS. 7, 5 and 3. Each lug 22*a-c* is positioned within corresponding lug ports 23 (FIG. 3) on the casing 12. The distal flange 40 is configured for sliding engagement with the drill bit 24, as further described below. That is, the distal flange 40 is slidingly connectable along the shank 44 of the drill bit. The lugs 22*a-c* are also sized and shaped with fit within lug ports 46 of the drill bit 24. The lugs 22*a-c* can optionally be tapered, as best shown in FIG. 7, such that the lugs 22*a-c* can be easily clamped down and secured to the bearing 20 by, for example, a sleeve 18.

Figure 9:
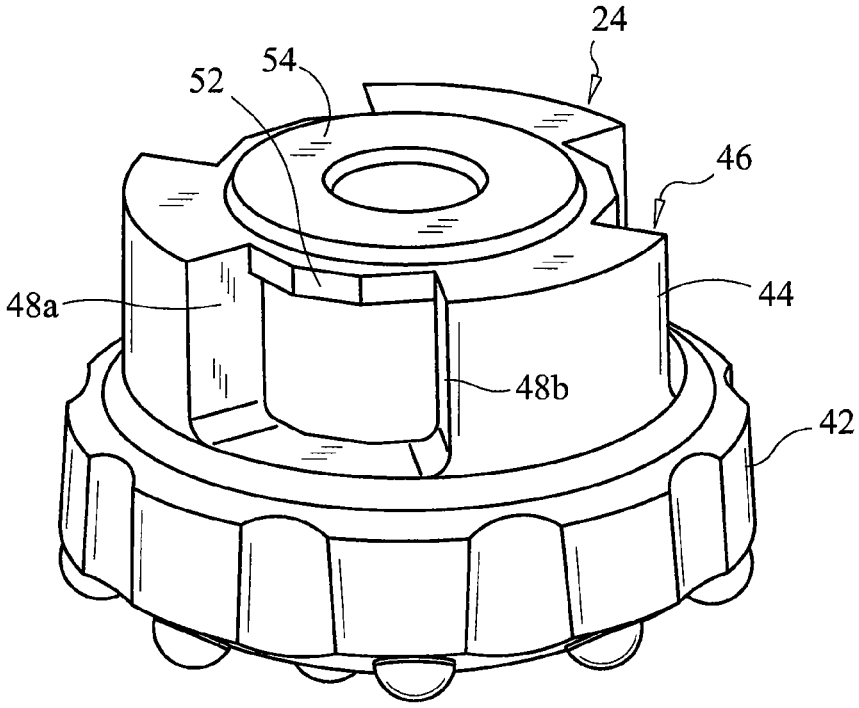
FIG. 9 is an enlarged perspective view of the drill bit of the embodiment of FIG. 4.

FIG. 9 illustrates the drill bit 24 in accordance with the present embodiment. The drill bit 24 is a single piece constructed part and configured with a head 42 and a shank 44 extending from the head 42. The head 42 is generally configured similarly to conventional heads or cutting heads used in DHD hammers. The shank 44 is a low-profile shank. That is, the shank 44 of the present embodiment is significantly shorter in length than conventional drill bit shanks. Whereas conventional drill bits include a shank with a longitudinal or axial length that is 300-500% longer than the axial length of a head, the axial length of the shank 44 is less than or about 200% of the axial length of the head 42. Preferably, the axial length of the shank 44 is less than about 100% of the axial length of the head 42. Depending upon the size diameter of a particular drill bit 24, the ratios of the axial lengths of the shank 44 and head 42 will vary. The low-profile drill bit 24 advantageously results in about a 50% or better reduction in the overall weight of the drill bit 24.

The shank 44 is also configured with a plurality of lug ports 46. The plurality of lug ports 46 includes three circumferentially spaced lug ports 46 that are configured to receive and engage the three lugs 22*a-c*, respectively. Each lug port 46 has two opposing drive surfaces 48*a*, 48*b* that can engage the corresponding lug drive surfaces 26*a*, 26*b* respectively. The drive surfaces 48*a*, 48*b* are configured to have a single point contact area that is greater than the single point contact area of conventional shank splines 1160. The single point contact area is defined as the contact area upon which a single lug drive surface (e.g., lug drive surface 26*a*) engages a lug port 46 drive surface (e.g., drive surface 48*a*). Preferably, the single point contact area of the drive surfaces 48*a*, 48*b* is about 25% greater than conventional single point contact areas of shank splines 1160 and more preferably about 50% greater than conventional single point contact areas of shank splines 1160. The drive surfaces 48*a*, 48*b* are also configured to extend radially outwardly further than conventional shank splines 1160. Preferably, the drive surfaces extend further radially outwardly by about 10% or more than conventional shank splines 1160 and more preferably about 25% or more than conventional shank splines 116.

The drive surfaces 48*a*, 48*b* are further configured to have a cross-sectional area normal to the central axis of the DHD hammer 10 that is greater than the cross-sectional area of conventional shank splines 1160. Preferably, the cross-sectional area of the drive surfaces 48*a*, 48*b* normal to the central axis of the DHD hammer 10 is about 15% greater than for conventional shank splines 1160 and more preferably about 50% greater than conventional shank splines 1160. The drive surfaces 26*a*, 26*b* of the lugs 22*a-c* of the present embodiment advantageously provides for a significantly larger surface area upon which the lugs 22*a-c* can apply a rotational force compared to the surface area provided for on conventional shank splines 1160, thus reducing the possibility of burning and stresses at the point of contact. Preferably, the overall diameter of the shank 44 is substantially equivalent to the overall diameter of the distal end of the casing 12.

The lug ports 46 each include a radially outwardly extending flange 52 formed about a top end of the shank 44. The plurality of lug ports 46 and flanges 52 are configured to receive the distal flange 40 of the lugs 22*a-c*, such that the distal flanges 40 of each lug 22 can slide along the longitudinal wall of their respective lug port 46. The flanges 52 also serve in part to secure the drill bit 24 to the rest of the DHD hammer 10.

The drill bit 24, having such a shallow or low-profile, advantageously reduces the amount of stress imparted upon the drill bit 24 as a result of the percussive movement of the piston 16 impacting the drill bit's 24 impact surface 54. That is, due to the reduced profile of the shank 44, the elastic stress waves observed by the shank 44 is reduced. Moreover, as a result of the reduced stresses imparted on the drill bit 24, the drill bit 24 can be manufactured from cylindrical bar stock material, such as a bar stock metal or alloy, and machined rather than forged material and a forging process. This allows for reduced material and manufacturing costs. In addition, the drill bit 24 is completely distal to the casing 12 yet operatively connected to the casing 12.

In sum, the DHD hammer 10 of the present embodiment provides for a drive coupling that can minimize contact pressures on the shank 44 while maximizing the shank's 44 cross-sectional area. In particular, the DHD hammer 10 can provide for a larger diameter shank 44 relative to conventional DHD hammer shank sections (such as shank section 1140), which therefore results in a larger torque moment arm (L) on the shank 44 and a larger shank 44 cross-sectional area. A larger diameter shank 44 can be made possible as a direct result of the lug based drive coupling.

Referring to FIG. 4, the DHD hammer 10 is assembled with the backhead 14 inserted into and connected to the top or proximal end of the casing 12. The backhead 14 can be connected to the casing by a threaded connection or any other suitable connection. The piston 16 is positioned within the casing 12 such that the piston 16 can move freely axially or longitudinally within the casing 12. At the bottom or distal end of the casing 12, the bearing 20 is inserted into the casing 12 so that the proximal flange 38 of each of the lugs 22*a-c* is attached to the annular slot 34 of the bearing 20 (as best shown in FIG. 7). The drill bit 24 is then positioned at the bottom end of the casing 12 such that the bottom flange 40 of each of the lugs 22*a-c* is positioned within the lug ports 46. The drill bit 24 and lugs 22*a-c* are then secured to the casing 12 and bearing 20 by the sleeve 18 which is fastened by a tapered threaded lock. This configuration of the DHD hammer 10 in accordance with the present embodiment, advantageously removes any threaded or securing members from being directly in line with elastic stress waves that result during drilling, eliminates high axial elastic stresses along the drill bit 24, eliminates aggressive sectional changes between the shank 44 and bit head 42, allows for the positioning of the drill bit 24 completely below the casing 12, and provides for improved manufacturability.

In operation, as the piston 16 percussively impacts against the impact surface 54 of the drill bit 24 which is maintained at or below the most distal edge of the casing 12, the drill bit 24 is rotationally moved by the lugs 22*a-c* engaging the lug ports 46. This advantageously results in less fatigue stress on the shank 44, due to its shallow profile and relatively large drive surface areas, thereby eliminating the problems associated with conventional chucks seizing on shank splines.

Figure 10:
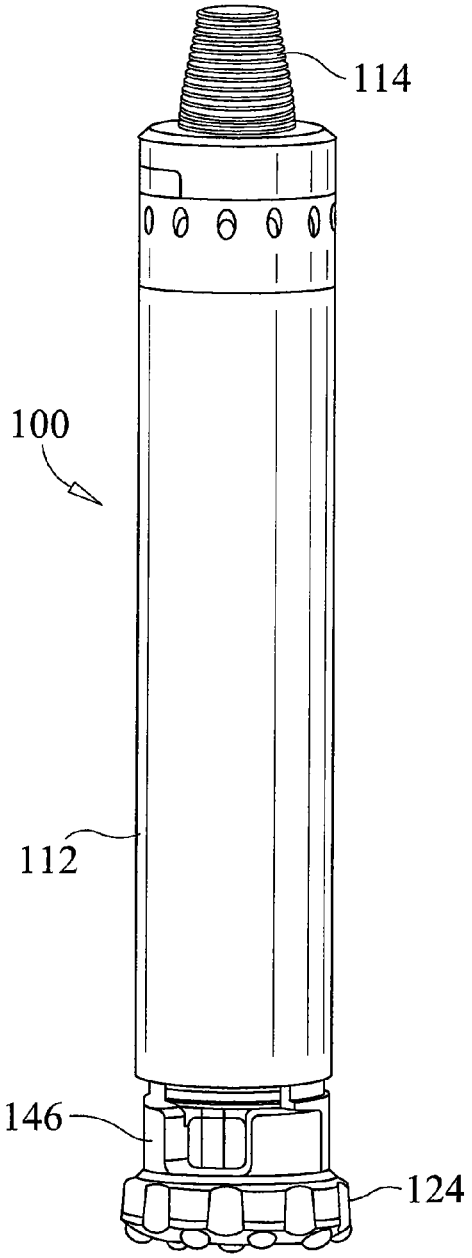
FIG. 10 is a perspective view of a DHD hammer in accordance with another preferred embodiment of the present invention, without a sleeve and without a segmented lug.
Figure 11:
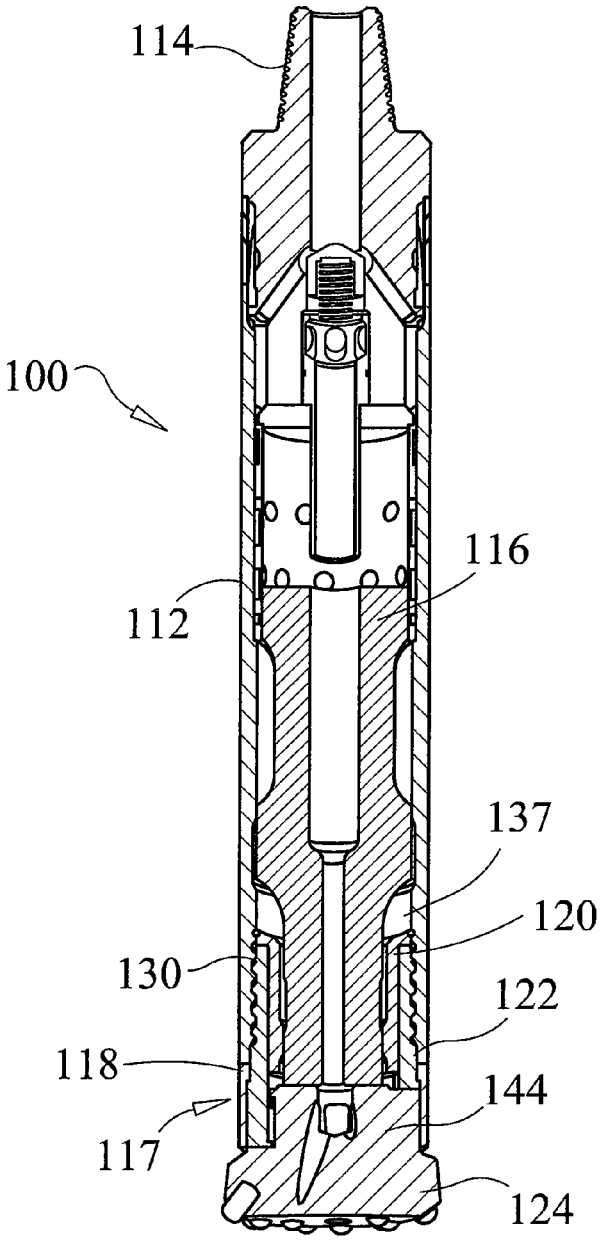
FIG. 11 is a cross-sectional perspective view of the DHD hammer of FIG. 10 with the sleeve and segmented lug in an assembled state.

In another preferred embodiment, the present invention provides for a DHD hammer 100, as shown in FIGS. 10-16. Referring to FIGS. 10 and 11, the DHD hammer 100 includes a casing 112, a backhead 114, a piston 116, a drive coupling 117 and a drill bit 124. The casing 112, backhead 114, piston 116 and drill bit 124 are substantially the same as described in the previous embodiment. The present embodiment differs from the previous embodiment in the structure and function of the drive coupling 117, which includes a sleeve 118, a bearing 120 and a plurality of segmented lugs 122.

Figure 12:
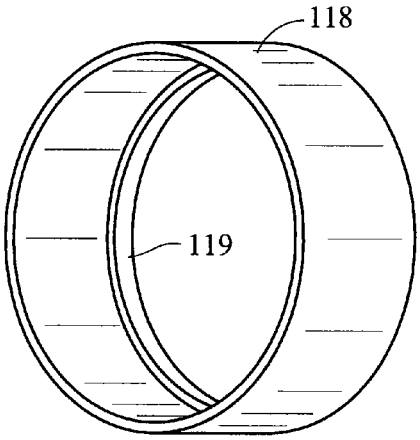
FIG. 12 is an enlarged perspective view of the sleeve of the embodiment of FIG. 10.

As best shown in FIGS. 11 and 12, the sleeve 118 is a cylindrical sleeve configured to receive the plurality of segmented lugs 122 and the drill bit 124. Toward the top or proximal end, the sleeve 118 includes an inwardly extending flange 119 for engagement with a corresponding flange on the segmented lugs 122, as best shown in FIG. 11. The length of the sleeve 118 is generally configured to receive lug extensions 123*a-c* (FIG. 16) of the segmented lugs 122 and a shank 144 of the drill bit 124.

Figure 13:
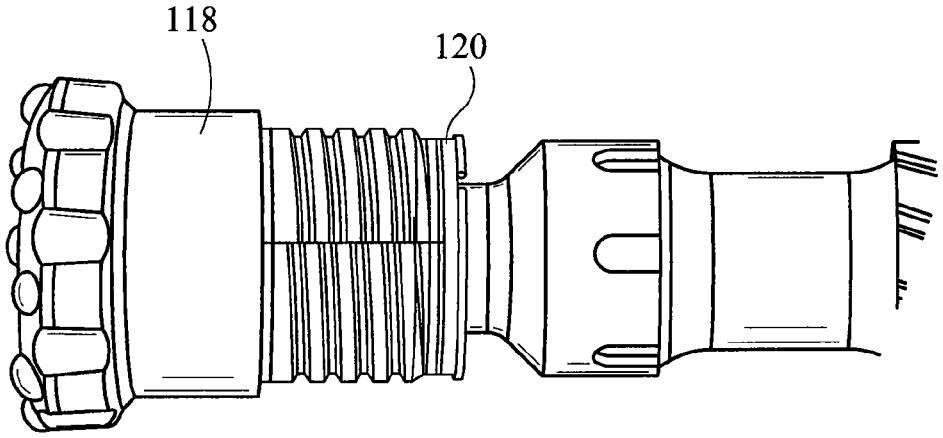
FIG. 13 is a partial side elevational view of the DHD hammer of the embodiment of FIG. 10 without a casing.
Figure 14:
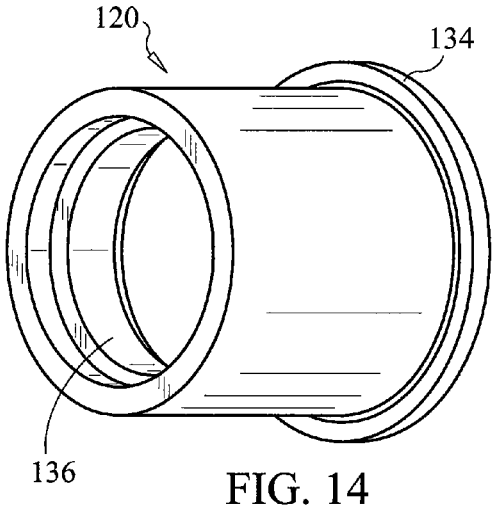
FIG. 14 is an enlarged perspective view of the bearing of the embodiment of FIG. 10.
Figure 15:
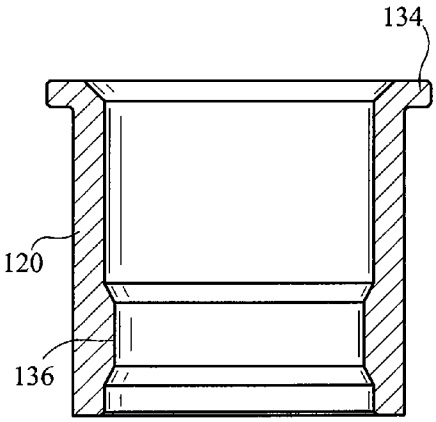
FIG. 15 is an enlarged cross-sectional view of the bearing of FIG. 14.

The bearing 120, as best shown in FIGS. 13-15, is a generally hollow cylindrical bearing and configured to receive the distal portion of the piston 16. The bearing 120 is also sized and shaped to fit within the segmented lugs 122*a-c*, as best shown in FIG. 13, and to allow for an unobstructed passageway for the piston 116 to travel through. About the proximal end of the bearing 120 is an outwardly radially extending flange 134 for mounting onto or engaging with the segmented lugs 122. Along the distal end of the bearing 120 along its inner surface, the bearing 120 includes an annular ridge 136 that protrudes radially inwardly relative to the bearing wall. The annular ridge 136 cooperates with the piston 116 to create a valve for exhausting air from the DHD hammer's 100 return chamber 137. In general, the bearing 120 is disposed proximate to the distal end of the casing 112.

Figure 16:
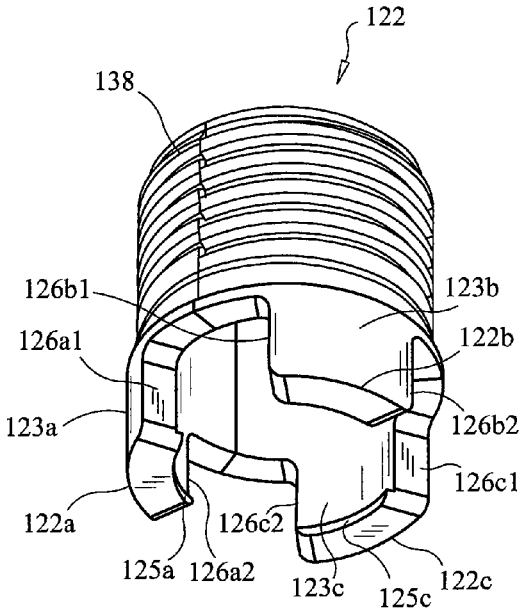
FIG. 16 is an enlarged perspective view of the segmented lugs of the embodiment of FIG. 10.

The plurality of segmented lugs 122, as assembled to the DHD hammer 100 is best shown in FIG. 13. As shown in FIG. 16, the segmented lugs 122 are preferably configured as three separate segments 122*a*, 122*b* and 122*c*. However, the plurality of segmented lugs 122 can be configured with more than three or less than three segments. The segmented lugs 122*a-c* are generally configured as arch-shaped segmented lugs, so as to form a generally cylindrical drive lug when assembled. About the top half or proximal end of the segmented lugs 122*a-c*, the external surface is configured with a connector, such as threads 138 for connecting with the casing 112. The threads 138 can connect to the casing 112 by, for example, internal casing threads 130, as best shown in FIG. 11. About the distal end of the segmented lugs 122*a-c* are arch-shaped lugs or lug extensions 123*a-c*, each having drive surfaces 126*a*1, 126*a*2, 126*b*1, 126*b*2, 126*c*1, and 126*c*2 respectively. The lug 123*a-c* are sized and shaped to fit within lug ports 146 of the drill bit 124 in a manner substantially the same as described for the above embodiment. In general, the segmented lugs 122 are configured to circumscribe the drill bit 124. Each of the arch-shaped lugs 123*a-c* also includes a radially inwardly extending flange 125*a-c* (only 125*a* and 125*c* shown in FIG. 16) extending from the distal portion of the lugs 123*a-c*. The radially inwardly extending flanges 125*a-c* are configured to slidingly engage one of the plurality of lug ports 146 on the drill bit 124.

Like the previous embodiment, the present embodiment advantageously provides for a DHD hammer 100 that experiences less overall stresses, is less susceptible to fatigue failure, and more easily maintenanced. In addition, the present embodiment also advantageously provides for a DHD hammer 100 that is simpler in design and more robust as a result of less overall parts forming the drive coupling 117 of the DHD hammer 100 relative to conventional DHD hammers.

In yet another preferred embodiment, the present invention provides for a DHD hammer 200 as shown in FIGS. 17A, 17B, 18, 21 and 23. The DHD hammer 200 includes a casing 212, a piston 216, a drill bit 224 and a drive coupling 217. The DHD hammer 200 with respect to its general operation is similar to that of the above embodiments. That is, the piston 216 is mounted within the casing 212 for reciprocating movement within the casing 212 about a longitudinal direction i.e., coaxial with axis-A. The operation and drive mechanisms for reciprocatively moving the piston 216 are known in the art and a detailed description is not necessary for a complete understanding of the present invention.

Figure 17A:
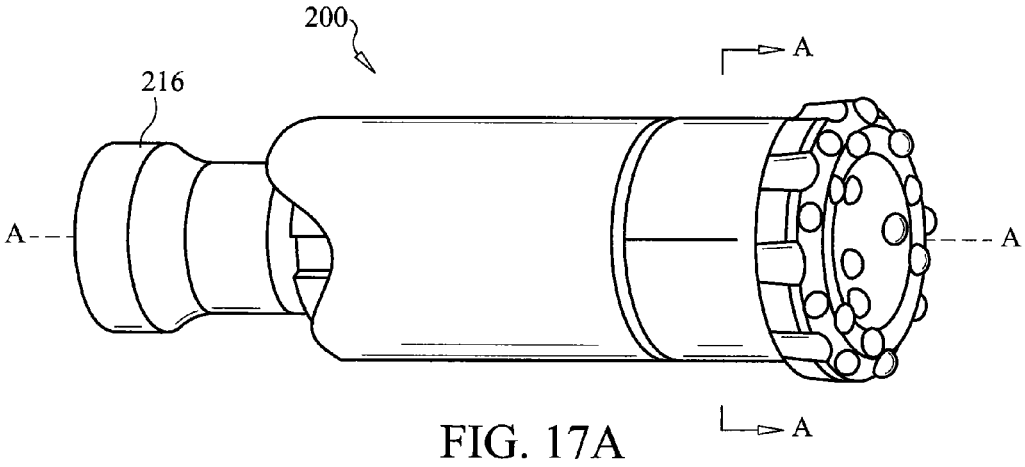
FIG. 17A is a perspective view a DHD hammer with a partial casing in accordance with yet another preferred embodiment of the present invention.
Figure 17B:
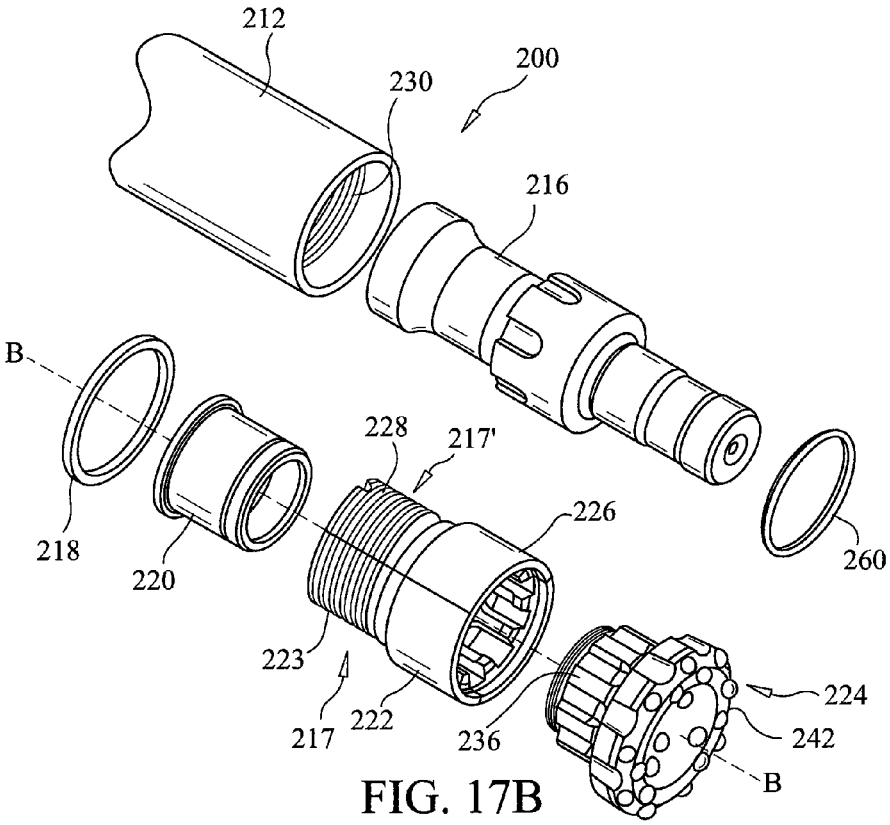
FIG. 17B is an exploded view of the DHD hammer of FIG. 17A.
Figure 18:
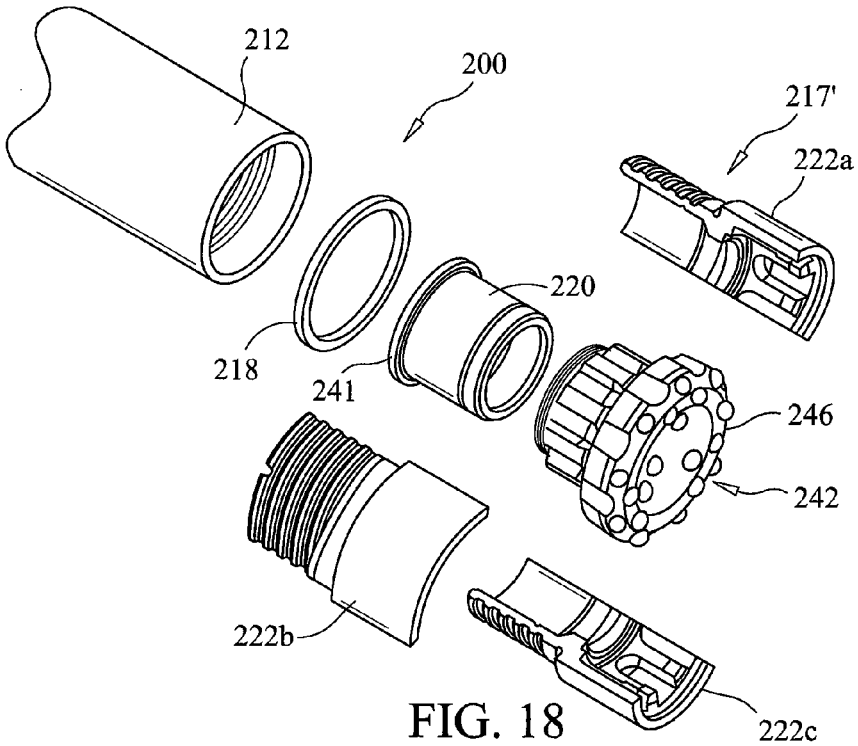
FIG. 18 is another exploded view of the DHD hammer of FIG. 17A.

The drive coupling 217 is configured as a chuck assembly 217'. The chuck assembly 217' includes a plurality of chuck segments, such as three chuck segments 222*a-c*, as shown in FIG. 18. The chuck segments 222*a-c* are configured to assemble into a cylindrical chuck 222, as shown in FIG. 17B. The cylindrical chuck 222 is a generally hollow cylindrical chuck and configured to receive and allow for the passage of the distal end of the piston 216 therethrough. The chuck assembly 217' is connected to the distal end of the casing 212.

The cylindrical chuck 222 includes a proximal end 223 and a distal end 226. The proximal end 223 is configured with a connector 228. Preferably the connector 228 is a threaded connector 228 for threaded engagement with corresponding threads 230 on the distal end of the casing 212. Preferably, the threaded connector 228 is configured along the outside surface of the cylindrical chuck 222 so as to engage corresponding threads 230 configured along an inside surface of the casing 212. The distal end 226 is configured to have an overall outside diameter that is larger than the overall outside diameter formed by the proximal end 223. Preferably, the overall outside diameter of the distal end 226 is substantially the same or greater than the overall outside diameter of the distal end of the casing 212. As a result, the distal end 226 of the cylindrical chuck 222 is completely distal to the casing 212.

Figure 19:
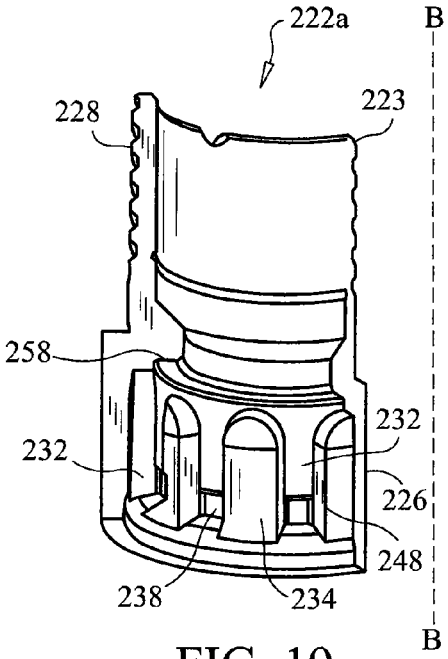
FIG. 19 is an enlarged perspective view of a chuck segment of the DHD hammer of FIG. 17A.

Referring to FIG. 19, there is shown an enlarged interior view of the chuck segment 222*a*. Each individual chuck segment 222*a*, 222*b*, 222*c*, is configured as an arch-shaped segment of approximately one hundred and twenty degrees such that the when each of the chuck segments 222*a-c* are arranged side by side circumferentially about axis-B, they form the cylindrical chuck 222. While the preferred embodiment discloses the cylindrical chuck 222 formed out of three chuck segments 222*a-c*, the cylindrical chuck 222 can alternatively be configured out of two or more chuck segments, such as four or five chuck segments.

The distal end 226 of the chuck segment 222*a* also includes a plurality of chuck splines 232 that extend radially inwardly. Each of the plurality of chuck splines 232 is configured to engage one of a plurality of shank splines 236, further described below. In between each of the plurality of chuck splines 232 is a groove 234 configured to receive a shank spline 236. About a distal end of each of the chuck splines 232 is an inwardly extending flange portion 238. Each of the inwardly extending flange portions 238 extends radially inwardly so as to engage an outwardly extending flange portion 240 (FIG. 20) on the drill bit 224 thereby retaining the drill bit 224 within the chuck assembly 217' when assembled. In general, the distal end 226 of the cylindrical chuck 222 is configured to receive the shank 244 of the drill bit 224.

Within the distal end 226 of the cylindrical chuck 222 is a radially inwardly extending flange 258. The flange 258 operatively engages a thrust surface 256 on a rearwardly facing surface of the shank 244, as further described below. When assembled into the cylindrical chuck 222, the flange 258 forms a substantially circular flange surface that correspondingly engages the thrust surface 256. This advantageously provides for the thrust surface 256 to be completely housed by and protected by the chuck assembly 217'.

Forming the cylindrical chuck 222 out of individual chuck segments advantageously allows for the cylindrical chuck 222 to integrally form the inwardly extending flange portions 238 directly on the chuck segments 222*a-c*. That is, the inwardly extending flange portions 238 is an integrally formed drill bit retaining mechanism. Therefore, the chuck segments 222*a-c* can be assembled around the drill bit 224 rather then the drill bit 224 having to be axially incorporated into the drive coupling 217. This eliminates additional parts and the complexities associated with axially incorporated drill bits to drive couplings in conventional DHD hammers.

Figure 21:
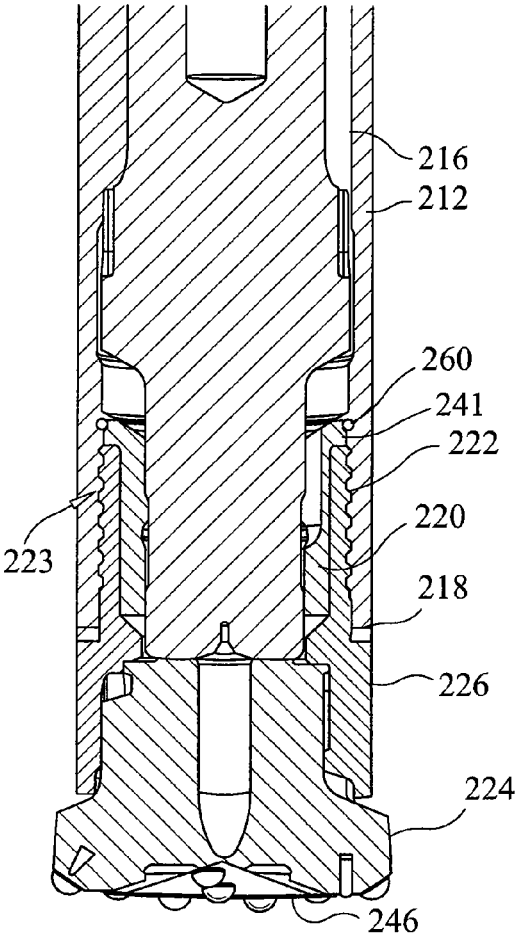
FIG. 21 is a partial side cross-sectional perspective view of a portion of the DHD hammer of FIG. 17A.

The chuck assembly 217' also includes a bearing 220, as best shown in FIGS. 17B, 18 and 21. The bearing 220 is a generally hollow cylinder to allow for the passage of the piston 216 therethrough and includes a radially outwardly extending flange 241 about its proximal end. The overall outside diameter of the bearing's 220 body is configured to be received by the proximal end of the cylindrical chuck 222, while the flange 241 is sized to fit within the casing 212 as well as mount on the most proximal end of the cylindrical chuck 222, as best shown in FIG. 21.

The chuck assembly 217' can optionally include a thrust washer 218 that circumscribes the cylindrical chuck 222. In an assembled state, the thrust washer 218 is situated to mount on the distal end 226 of the cylindrical chuck 222, as shown in FIG. 21. The thrust washer 218 advantageously aids in assembling and maintaining the cylindrical chuck 222 in its cylindrical configuration.

Figure 20:
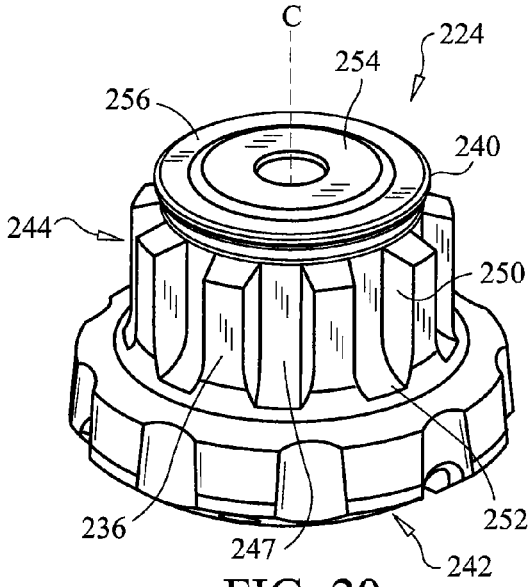
FIG. 20 is a perspective view of a drill bit of the DHD hammer of FIG. 17A.

Referring to FIGS. 18 and 20, the drill bit 224 includes a head 242 and a shank 244. The head 242 includes a forwardly facing cutting surface 246 for impacting, cutting and generally boring drill holes. The head 242 is also configured with an overall diameter that is larger than the shank 244.

The shank 244 is a low-profile shank. That is, the longitudinal length of the shank 244 extending along axis-C is shorter in length compared to conventional drill bit shanks. Preferably, the shank 244 is less than about 200% of the longitudinal length of the head 242 and more preferably, less than about 100% of the longitudinal length of the head 242.

Figure 22:
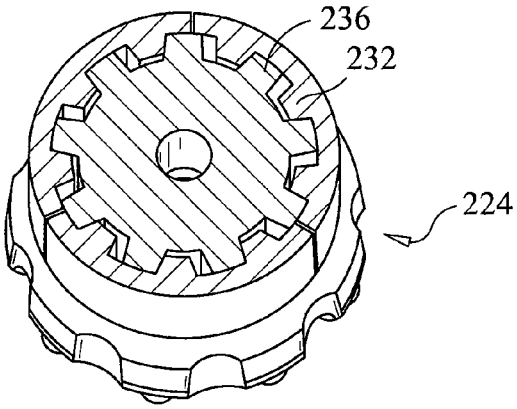
FIG. 22 is a perspective top cross-sectional view of the DHD hammer of FIG. 17A taken along section A-A.

The shank 244 includes a plurality of shank splines 236 circumferentially spaced about the shank 244. In between each of the plurality of shank splines 236 is a groove 247 configured to receive a chuck spline 232. The plurality of chuck splines 232 and shank splines 236 are configured to operatively engage each other as shown in FIG. 22. A side edge 248 of each chuck spline 232 contacts a side edge 250 of a shank spline 236 about a single point contact area that is greater than the contact area for conventional shank splines 1160. This is in part due to the larger overall diameter of the shank 244 provided for as the size of the shank 244 is not restricted by the casing 212.

Referring to FIG. 20, each grove 247 is configured so that its distal end sweeps radially outwardly. The radially outwardly distal end 252 helps remove and keep debris from entering the DHD hammer 200. In addition, the shapes and configurations of the shank splines 236, chuck splines 232 and grooves 234, 247 allow for improved manufacturability, such as the ability to manufacture parts from single-pass cutting operations and for improved heat treatment due to more uniform cross sections of the overall parts.

Preferably, the shank 244 and cylindrical chuck 222 are each configured with nine splines. It has been discovered that nine corresponding splines advantageously allows for the cylindrical chuck 222 and shank 244 to be configured with the greatest amount of torque without significantly impacting galling. However, the number of splines for the shank 244 and cylindrical chuck 222 can be more or less than nine depending upon the overall size of the DHD Hammer 200.

About the proximal end of the shank 244 is the outwardly extending flange portion 240. The outwardly extending flange portion 240 extends radially outwardly beyond the groove's 247 longitudinal surface, but not past the outer radial edges of the shank splines 236. The outwardly extending flange portion 240 is also integrally formed with the drill bit's thrust surface 256. The thrust surface 256 is normal to the longitudinal direction of the drill bit 244 and configured as a generally circular ring-shaped thrust surface 256.

Concentric with the thrust surface 256 is the drill bit's impact surface 254. The impact surface 254 is slightly raised relative to the plane of the thrust surface 256. The impact surface 254 is configured to receive the percussive impact forces of the piston 216.

As best shown in FIG. 21, the proximal end 223 of the cylindrical chuck 222 connects to the distal end of the casing 212. The distal end 226 of the cylindrical chuck 222, however remains completely distal to the casing 212. The distal end 226 of the cylindrical chuck 222 couples to the drill bit 224 through its shank 244 thereby partially housing the drill bit 224. When coupled, the drill bit 224 can move axially along the distal end 226 of the cylindrical chuck 222. However, when in use, the cutting surface 246 is forced against the bottom of the drill hole being drilled, which consequently forces the drill bit 224 up into the distal end 226 of the cylindrical chuck 222 as far as possible, thereby engaging the thrust surface 256 against the flange 258 at the distal end of the cylindrical chuck 222 (FIG. 19). When the thrust surface 256 is engaged with the flange 258, the impact surface 254 remains distal to the casing 212, thereby positioning the point of impact for the piston 216 below the casing 212. In other words, the entire drill bit 224 remains distal to (i.e., outside of) the casing 212.

Because the distal end 226 of the cylindrical chuck 222 is distal to the casing 212, the overall diameter of the distal end 226 can advantageously be made larger. That is, since the distal end 226 is not located within the casing 212, the overall dimensions of the distal end 226 is not restricted by the internal dimensions of the casing 212. As a result, since the distal end 226 can be made larger, the overall diameter of the shank 244 can be made larger. This is advantageous since a larger shank diameter allows for larger torque. In addition, the overall diameter of each of the shank splines 236 is greater than the bore diameter of the casing 212. Alternatively, the overall diameter of the shank splines 236 can be made equal to the bore diameter of the casing 212.

Figure 23:
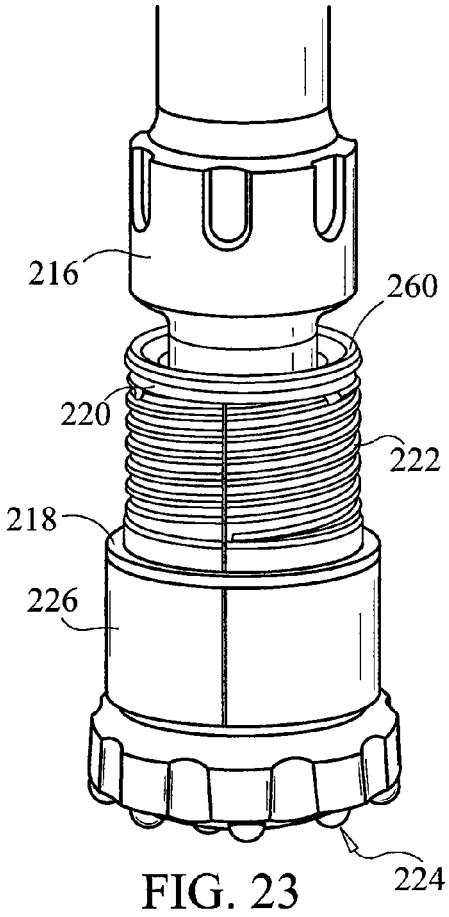
FIG. 23 is a partial perspective view of a portion of the DHD hammer of FIG. 17A without a casing.

The DHD hammer 200 can also optionally include a seal 260, as shown in FIGS. 17B, 21 and 23. The seal 260 can be any seal capable of forming a seal, such as a hermetic seal. The seal 260 can be a polymeric seal, such as an elastomer or plastic. The seal 260 is positioned between the bearing 220 and casing 212, as shown in FIG. 21.

Similar to the above embodiments, the present embodiment advantageously provides for a drive coupling 217 that minimizes contact pressures and maximizes torque on the drill bit 224. This is accomplished by providing a shank with a lower profile and larger diameter relative to conventional DHD hammers. These advantages are distinctly provided for by positioning the drill bit 224 distal to the casing 212. Additionally, the cylindrical chuck 222 can be radially assembled onto the drill bit 224, which therefore allows for an integrally formed drill bit retaining mechanism on the drive coupling 217 to maintain the drill bit 224 onto the DHD hammer 200 while maintaining the drill bit 224 distal to the casing 212.

In sum, the DHD hammer 200 of the present embodiment provides for a drive coupling assembly that minimizes contact pressures on the shank 244 while maximizing the shank's 244 cross-sectional area. This is accomplished by providing a larger diameter shank 244 relative to conventional DHD hammer shank sections (such as shank section 1140), which therefore results in a longer torque moment arm (L) on the shank 244 and a larger shank 244 cross-sectional area ($Area_{shank}$). A larger diameter shank 244 is made possible as a direct result of the lug based drive coupling. This benefit can be expressed as a ratio (R) of the shank cross-sectional sectional area ($Area_{shank}$), torque contact area ($Area_{contact}$), and torque moment arm (L) relative to the applied torque (T) as defined by Ratio 1 below.

$$R = \frac{\text{Area}_{shank} \times \text{Area}_{contact} \times L}{T} \qquad \text{Ratio 1}$$

As defined by Ratio 1, the present embodiment can provide for a DHD hammer having a ratio R that is increased up to about 28% or more.

It will be appreciated by those skilled in the art that changes could be made to the embodiments described above without departing from the broad inventive concept thereof. It is understood, therefore, that this invention is not limited to the particular embodiments disclosed, but it is intended to cover modifications within the spirit and scope of the present invention as defined by the appended claims.

What is claimed is:

1. A down-the-hole drill hammer comprising:
a cylindrical housing;
a piston mounted within the housing along a longitudinal direction and configured to reciprocatively move within the housing along the longitudinal direction;
a drill bit assembly disposed completely below the housing, the drill bit assembly including:
a head,
a shank extending from the head;
a plurality of shank splines circumferentially spaced about the shank; and
a drive coupling engaging the housing and the drill bit assembly, the drive coupling including a chuck assembly connected to a distal end of the housing, the chuck assembly including:
a plurality of chuck segments each having:
a proximal end that includes a connector for connecting to the housing,
a distal end configured to receive the shank, and
a plurality of chuck splines each configured to engage one of the plurality of shank splines.

2. The down-the-hole drill hammer of claim 1, wherein the plurality of chuck segments is configured as a cylindrical chuck.

3. The down-the-hole drill hammer of claim 2, wherein a distal end of the cylindrical chuck assembly includes the plurality of chuck splines and is configured with an overall diameter that is larger than the proximal end of the cylindrical chuck assembly that includes the connector and wherein the shank extends into the distal end of the cylindrical chuck assembly.

4. The down-the-hole drill hammer of claim 3, wherein the plurality of chuck splines includes an inwardly extending flange portion configured to engage an outwardly extending flange portion on a proximal end of the shank.

5. A down-the-hole drill hammer comprising:
a cylindrical housing;
a piston mounted within the housing;
a drill bit at a distal end of the housing, the drill bit including a plurality of shank splines circumferentially spaced about a shank of the drill bit; and
a drive coupling engaging the housing and the drill bit, the drive coupling including a chuck assembly having a plurality of individual and separable chuck segments each having:
a proximal end for connecting to the housing,
a distal end configured to receive the shank, and
a plurality of chuck splines configured to engage the plurality of shank splines.

6. A down-the-hole drill hammer comprising:
a housing;
a piston mounted within the housing for reciprocatively movement therein;
a drill bit disposed about a distal end of the housing, the drill bit including:
a head, and
a shank extending from the head; and
a chuck assembly comprising:
a plurality of chuck segments each having:
a proximal end that includes a connector for connecting to the housing, and
a distal end having a plurality of chuck splines wherein the shank is completely housed within the distal end of the chuck assembly.

* * * * *